US007047676B2

(12) United States Patent
Nicholson et al.

(10) Patent No.: US 7,047,676 B2
(45) Date of Patent: May 23, 2006

(54) ROTATIONAL AND POSITIONABLE ARM-CONTROLLED UNDERWATER BOTTOM ARTIFACT AND SAMPLE SUCTION RECOVERY APPARATUS AND INTERCHANGEABLE BOTTOM CORING APPARATUS

(75) Inventors: Michael A. Nicholson, Picayune, MS (US); Robert H. Rines, Concord, NH (US); William D. Donohue, Fort Worth, TX (US); Elijah T. Ercolino, Boston, MA (US)

(73) Assignee: Academy of Applied Science, Concord, NH (US)

( * ) Notice: Subject to any disclaimer, the term of this patent is extended or adjusted under 35 U.S.C. 154(b) by 88 days.

(21) Appl. No.: 10/818,262

(22) Filed: Apr. 2, 2004

(65) Prior Publication Data

US 2005/0229439 A1 Oct. 20, 2005

(51) Int. Cl.
*E02F 9/10* (2006.01)

(52) U.S. Cl. ..... 37/334

(58) Field of Classification Search ..... 37/324, 37/323, 334, 336

See application file for complete search history.

(56) References Cited

U.S. PATENT DOCUMENTS

| | | | | | |
|---|---|---|---|---|---|
| 1,994,884 | A | * | 3/1935 | Chew | 37/323 |
| 3,122,398 | A | * | 2/1964 | Tucker | 241/38 |
| 3,995,439 | A | * | 12/1976 | Hahlbrock | 405/161 |
| 4,024,655 | A | * | 5/1977 | Schweitzer | 37/319 |
| 4,058,914 | A | * | 11/1977 | Kiss | 37/329 |
| 4,123,858 | A | * | 11/1978 | Batchelder | 37/313 |
| 4,418,484 | A | * | 12/1983 | Wolters et al. | 37/323 |
| 4,631,844 | A | * | 12/1986 | Deal | 37/324 |
| 5,487,229 | A | * | 1/1996 | Nathenson et al. | 37/347 |
| 6,112,439 | A | * | 9/2000 | Rinker | 37/305 |

* cited by examiner

*Primary Examiner*—Victor Batson
(74) *Attorney, Agent, or Firm*—Rines and Rines

(57) ABSTRACT

A novel rotational and positionable robotic arm-controlled underwater bottom artifact and sample suction recovery apparatus and interchangeable bottom coring apparatus, wherein the interchange is effected underwater by rotation of a common deploying arm and remote-control mechanism.

14 Claims, 2 Drawing Sheets

Figure 1:
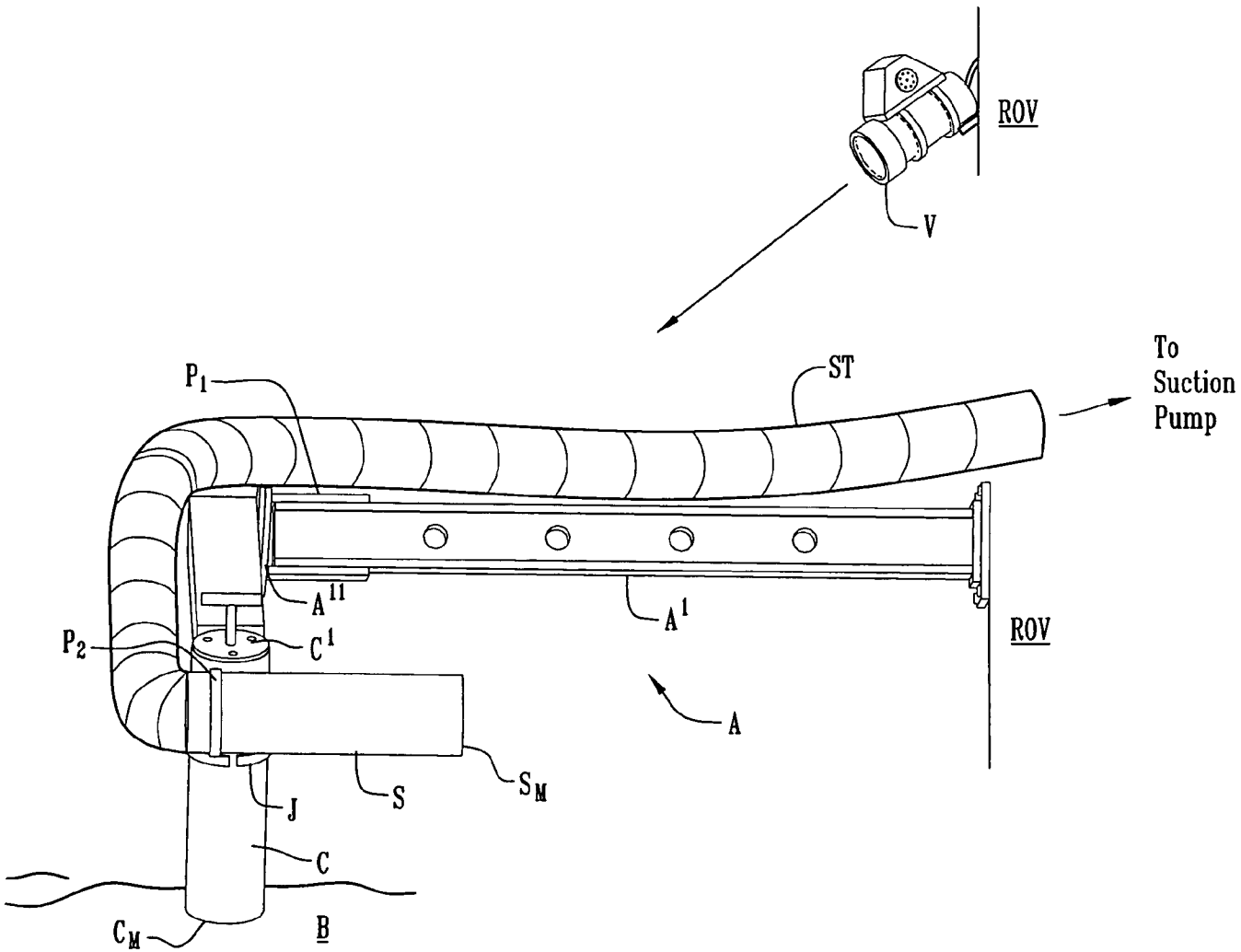

ROTATIONAL AND POSITIONABLE ARM-CONTROLLED UNDERWATER BOTTOM ARTIFACT AND SAMPLE SUCTION RECOVERY APPARATUS AND INTERCHANGEABLE BOTTOM CORING APPARATUS

FIELD

The present invention relates to the field of underwater remotely operated vehicle structures and the like, being more particularly concerned with the recovery both by suction and by coring of bottom and sub-bottom materials, artifacts and samples and the like, with the aid of common robotic or similar rotatable and three-dimensionally orientable mechanical arms and similar structures.

BACKGROUND

The art of remotely recovering underwater bottom artifacts and samples has now been well-developed by oceanologists, oceanographers, limnologists and lake researchers and others. Underwater suction hoses and sample recovery bottles are in frequent use as described, for example, in a publication disclosing the use of suction in the Ocean Explorer Webmaster of NOAA (2003), and also suction sampler apparatus of Harbor Branch Oceanographic Institute. Similarly, coring apparatus is in wide use as described, for example, in websites of the Serpent Soc and in a paper of I. R. Hudson et al, "Collaboration in Deep-sea Biodiversity", etc. appearing in the proceedings of the Society of Petroleum Engineers Conference of March 29–31, 2004.

There are, none-the-less, special circumstances where such prior art techniques do not lend themselves to adequate real-time research results; including the lack of the capability for facile and almost instantaneous underwater interchange at will of suction and of coring operations as the attempted recovery of certain bottom or sub-bottom objects and materials is undertaken; or the switching back and forth between suction and coring may be desirable, for example, as stubborn or especially friable objects may require—all without having to surface the equipment (carried, for example, by an ROV vehicle or the like) as for purposes of equipment modification, adjustment, supplementation or substitution. Such circumstances have been particularly encountered by us in connection with a discovered marine bed and other deposits of various sizes in bottom layers recently found in freshwater Loch Ness in Scotland and described in an article entitled "Proof Positive—Loch Ness Was An Ancient Arm Of The Sea", by Robert H. Rines and Frank M. Dougherty, Journal of Scientific Exploration, Vol. 17, No. 2, 2003, p. 317–323, and with newly discovered friable organisms living at extreme depths therein (Sparks 2001, Vol. 1, 2001, page 3, Academy of Applied Science).

It is to these and related special problems, accordingly, that the present invention is primarily directed, though it provides tools for other and more general similar applications as well.

OBJECTS OF INVENTION

Accordingly, it is a principal object of the invention to provide a new and improved underwater arm-controlled bottom artifact and sample suction recovery and automatically interchangeable bottom coring apparatus that shall not be subject to the above and other limitations of the prior art; but that, to the contrary, provides novel underwater interchangeably operative suction and coring systems remotely operated by the same common arm and remote-control structures, and with facility for repeatedly interchanging the operations, at will.

A further object is to provide a novel interchangeable suction and coring apparatus of more general use as well.

Other and further objects will be described hereinafter and are more fully delineated in the appended claims.

SUMMARY

In summary, however, in one of its principal applications, the invention embraces a mechanically rotatably and horizontally and vertically adjustably positionable deploying manipulator arm carrying a recovery system for enabling underwater bottom artifact and sample recovery and the like, and also for optionally or interchangeably enabling bottom coring operations, having, in combination, an adjustably rotational and positionable longitudinally extending arm terminating in jaw or claw fingers; a suction tube having a longitudinal terminal section and mounted along and to the arm and having a mouth extending longitudinally beyond the fingers; and a bottom coring tube positioned rearward of the suction tube mouth and held by the fingers to extend transversely to the arm with a coring mouth thereof transversely spaced from the arm, such that, with the arm positioned substantially longitudinally parallel to the bottom, the coring tube is substantially vertically oriented withits mouth facing the bottom so as to be driven by the arm into the bottom to obtain a core of bottom and sub-bottom material; and with the arm rotated about its longitudinal axis to elevate the coring tube to extend transversely to the bottom, while the suction tube is interchangeably rotationally lowered to bring its mouth towards the bottom to suck in objects thereupon or therein, and vice versa.

Preferred and best-mode designs are hereinafter more fully described in detail.

DRAWINGS

Figure 2:
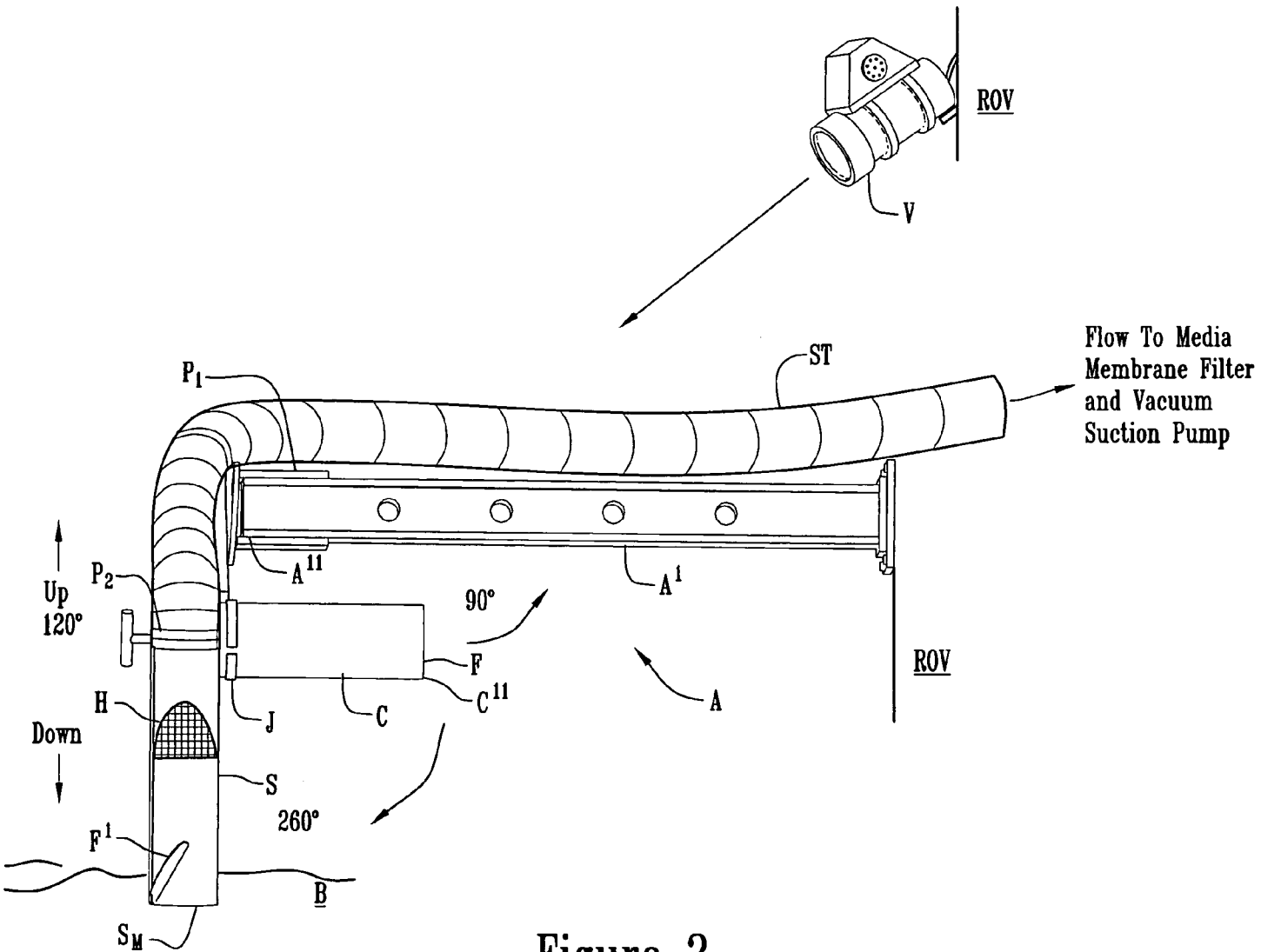

The invention will now be described in connection with the accompanying drawings, FIG. 1 of which is an isometric view of a preferred construction suited particularly for ROV operations and the like and illustrating the system in coring mode; and FIG. 2 is a similar view of the readily interchangeable suction mode.

DESCRIPTION OF PREFERRED EMBODIMENT OF INVENTION

Referring to FIG. 1, the invention is illustrated as used with a submersible underwater vehicle such as an ROV or the like, so labeled, as described, for example, in the above-referenced article, and a preferably electrically orientable three-dimensionally robotic mechanical joint-linked wrist-like manipulator system A thereof, remotely controlled from a tender vessel (not shown) by a signal and power tether or cable, and operated from the tender through the monitoring of one or more video cameras V carried by the vehicle. The robotic arm manipulator A may, for example, be of the type described in the current Deep Sea Systems International Inc. EMP-5000 fliers or similar equipment of R.O.V. Technologies Inc. and others.

The manipulator system A terminates in a longitudinal arm section $A^1$ having a wrist joint section $A^{11}$ carrying a terminal jaw, claw or clamp fingers J, also remotely operable and controlled from the tender, as is also well-known.

In accordance with the present invention, a preferably flexible pump-connected suction hose ST (desirably transparent so that contents can be observed by the video cameras V) is attached as at point P1 to and along the longitudinal arm section $A^1$ and at P2 to the wrist section $A^{11}$ which is angularly adjustable relative to $A^1$ and terminally carries the jaw or claw fingers J. The hose ST terminally mounts a rigid suction tube S, and in the position of FIG. 1, the mouth $S_M$ of the suction tube S is shown elevated (horizontally) above the bottom B, extending beyond or in front of the terminal jaw or claw fingers J of the arm wrist section $A^{11}$. The jaws J in turn are shown holding a rigid hollow coring tube C oriented to extend transversely of the elevated suction tube S, preferably substantially vertically perpendicularly thereto, and extending downward at right angles into the bottom B.

A convenient jaw mounting for the core tube C is a top sealing cover $C^1$. The opposite coring mouth $C_M$ of the core tube C may preferably be circumferentially beveled or sharpened at $C^{11}$ (more particularly shown in FIG. 2) to aid in the coring penetration into the bottom B when the wrist arm $A^{11}$ is rotated to orient the coring tube C vertically, facing into the bottom B, while simultaneously elevating the suction tube S into a substantially horizontal position above the bottom.

When it is desired to interchange from the coring mode to the bottom section mode, the arm suction $A^1$ is rotated about its longitudinal axis to elevate the coring tube C from the bottom B and interchangeably rotationally to lower the suction tube S to orient its mouth $S_M$ to point towards the bottom B as shown in FIG. 2. The suction tube S may then suck in objects under the suction of pumps rearward of the tube ST, as labeled.

With the positioning of the ROV and the rotation of the arm sections $A^1$–$A^{11}$ orienting the suction tube S downward vertically toward the bottom B, FIG. 2, desired objects or bottom material, etc. may be sucked in along the flexible tube ST to a sample container(s) near the pump (not shown) under the remote control of the ROV operator in the tender vessel as the operator monitors the video screen.

If this operation is not producing the desired results, or supplementary results are indicated, such as sub-bottom layer recovery, etc., the invention, as earlier explained, enables a rapid automatic underwater interchange back from such suction recovery mode of FIG. 2 to the coring mode of FIG. 1 for penetrating the bottom B and its materials with the aid of the coring tube C. As before mentioned, the coring tube is closed at its top $C^1$ to enable holding the cored material within the tube as the ROV is surfaced for recovery.

The mouth $C_M$ of the coring tube C is preferably fitted with a resilient closure flap, such as an internal slit rubber disc or spring-controlled flap F, FIG. 2, that may spring outwardly shut when the coring tube is withdrawn from the bottom B with an O-ring seal. Such a flap may also, if desired, be used in the suction hose mouth $S_M$, as at $F^1$, the application of suction from the suction pumps before mentioned, opening the flap.

Both the coring tube C and the suction tube S may further be sealed before the ROV surfaces by operating the arm sections $A^1$–$A^{11}$ to jam the respective mouths $S_M$ and $C_M$ against resilient pad(s), not shown, mounted on the vehicle structure.

Thus, in one position of the arm sections $A^1$, $A^{11}$, FIG. 1, the coring tube mouth $C_M$ may be driven into the bottom to obtain a core sample of bottom and sub-bottom material therein. Then, with the arm $A^1$ rotated about its longitudinal access through about ninety degrees (for the substantially orthogonal mounting of tubes S and C), the coring tube C is elevated and the suction tube opening $S_M$ is interchangeably rotationally lowered, FIG. 2, to point toward the bottom B to suck in objects therein or thereupon, as desired.

Preferably, as also illustrated in the drawings, the distances of the suction tube mouth $S_M$ and the coring tube mouth $C_M$ from their respective mountings to the arm sections $A^1$–$A^{11}$ are substantially the same; and, as before explained, the tubes are preferably positioned substantially nearly orthogonal to one another, though they may be at a somewhat lesser or greater angle, if desired.

Where desired, filters to catch materials may be inserted within the suction tube S. A useful porous filter has been found to be an inner lining of hose or stocking fabric mesh H or the like, FIG. 2.

Further modifications will also occur to those skilled in this art, and such are considered to fall within the spirit and scope of the invention as defined in the appended claims.

What is claimed:

1. A mechanically rotatably and horizontally and vertically adjustably positionable deploying manipulator arm carrying a recovery system for enabling underwater bottom artifact and sample recovery and also for optionally or interchangeably enabling bottom coring operations, having, in combination, an adjustably rotational and positionable longitudinally extending arm terminating in jaw or claw fingers; a flexible suction tube having a longitudinal section mounted along and to the arm and having a mouth extending longitudinally beyond the fingers; and a bottom coring tube positioned rearward of the suction tube mouth and held by the fingers to extend transversely to the arm with a coring mouth thereof transversely spaced from the arm, such that, with the arm positioned substantially longitudinally parallel to the bottom, the coring tube is substantially vertically oriented with its mouth facing the bottom so as to be driven by the arm into the bottom to obtain a core of bottom and sub-bottom material; and with the arm rotated about its longitudinal axis to elevate the coring tube from the bottom, the suction tube is interchangeably rotationally lowered to bring its mouth towards the bottom to suck in objects thereupon or therein, and vice versa.

2. The recovery system of claim 1 wherein the mounting of the coring tube upon the arm is effected by the jaw or claw fingers clamping near or at a closed top of the coring tube.

3. The recovery system as claimed in claim 1 wherein the deploying arm is part of a robotic three-dimensionally adjustable jointed wrist-like recovery arm apparatus mounted on a submersible vehicle provided with means for remotely controlling and adjusting the arm apparatus.

4. The recovery system as claimed in claim 3 wherein the vehicle is provided with video monitoring means for enabling such remote-control and adjustment.

5. An underwater bottom artifact and sample recovery and bottom coring apparatus having, in combination, an adjustable rotational and positionable longitudinally extending manipulator arm; a suction tube having a longitudinal terminal section mounted longitudinally along and to the arm and having a mouth extending longitudinally beyond the arm; and a bottom coring tube positioned rearward of the suction tube mouth and having a coring tube mouth and mounted to extend transversely to the arm with the coring tube mouth transversely spaced from the arm, wherein rotation of the arm about its longitudinal axis selectively rotates the suction tube mouth towards or away from an underwater bottom while the coring tube mouth rotates away from or towards the bottom, respectively, alternatingly to enable interchangeable suction and coring operations.

6. The apparatus of claim 5 wherein the coring tube is mounted by being held on the arm by jaw fingers thereprovided.

7. The apparatus of claim 6 wherein the coring tube is mounted upon the arm rearward of the jaw fingers thereof.

8. The apparatus of claim 5 wherein the terminal section of the suction tube and the coring tube are substantially nearly orthogonal to one another.

9. The apparatus of claim 8 wherein the distances of the suction tube mouth and the coring tube mouth from the mounting of the latter on the arm, are substantially the same.

10. The apparatus of claim 5 wherein an angle of rotation of the arm between suction tube and coring tube engagement with or near the bottom is substantially ninety degrees.

11. The apparatus of claim 5 wherein one or both of the suction tube and coring tube mouths is or are fitted with resilient closure flaps for closing after bottom materials have entered therein.

12. The apparatus of claim 11 wherein the suction tube is provided with an inner lining of fine porous hose-like fabric.

13. The apparatus of claim 5 wherein the coring tube mouth is beveled or sharpened to aid penetration.

14. The apparatus of claim 5 wherein jaw fingers hold the coring tube to extend transversely of the arm and downwardly to thrust into the bottom.

* * * * *